United States Patent [19]

Thompson et al.

[11] Patent Number: 4,627,717

[45] Date of Patent: Dec. 9, 1986

[54] CLEANING APPARATUS FOR A XEROGRAPHIC REPRODUCING APPARATUS

[75] Inventors: Michael D. Thompson, Rochester; Clifford W. Imes, IV, Williamson, both of N.Y.

[73] Assignee: Xerox Corporation, Stamford, Conn.

[21] Appl. No.: 701,890

[22] Filed: Feb. 14, 1985

[51] Int. Cl.[4] ..... G03G 21/00

[52] U.S. Cl. ..... 355/15; 118/652

[58] Field of Search ..... 355/15, 3 R, 3 DD; 15/1.5, 256.5; 118/652

[56] References Cited

U.S. PATENT DOCUMENTS 3,617,123 11/1971 Emerson ..... 355/15
4,265,990 5/1981 Stolka et al. ..... 430/59
4,426,151 1/1984 Aguro et al. ..... 355/15
4,515,467 5/1985 Suzuki ..... 15/256.52 X
4,530,596 7/1985 Kawamoto et al. ..... 355/15

*Primary Examiner*—R. L. Moses
*Attorney, Agent, or Firm*—Mark Costello

[57] ABSTRACT

Cleaning apparatus for removing residual single component magnetic toner from a charge retentive surface. The cleaning apparatus comprises a magnetic cleaning roller and a magnetic image disturber, the latter of which includes a pair of blade members which are spacially oriented so that two adjacent ends thereof form a gap therebetween which is disposed adjacent the charge retentive surface. The opposite ends of the blade members are disposed adjacent the magnetic roller such that upon rotation of the roller a pulsating magnetic field is created across the gap.

6 Claims, 3 Drawing Figures

CLEANING APPARATUS FOR A XEROGRAPHIC REPRODUCING APPARATUS

BACKGROUND OF THE INVENTION

This invention relates to the art of forming toner images on a charge retentive surface and, in particular to an apparatus for removing residual toner material from the photoconductive surface of an automatic xerographic reproducing apparatus.

In the art of xerography, a charge retentive surface generally comprising a photoconductive insulating material adhered to a conductive backing is charged uniformly. Then, the uniformly charged plate is exposed to a light image of an original document to be reproduced. The latent electrostatic images, thus formed, are rendered visible by applying any one of numerous pigmented resins specifically designed for this purpose. In the case of a reusable photoconductor, the pigmented resin, more commonly referred to as toner, which forms the visible images is transferred to plain paper.

Although a preponderance of the toner forming the images is transferred to the paper during transfer, some toner remains on the photoconductor surface, it being held thereto by relatively high electrostatic and/or mechanical forces. It is essential for optimum operation that the toner remaining on the surface be cleaned therefrom.

A commercially successful mode of cleaning employed in automatic xerography utilizes a brush with soft bristles which have suitable triboelectric characteristics. While the bristles are soft they are sufficiently firm to remove residual toner particles from the xerographic plate. In addition, webs or belts of soft fibrous or tacky materials and other cleaning systems are known.

In spite of the successes that have been achieved in removing residual toner from photoconductor surfaces there is still room for improvement. This is especially true in the case where single component magnetic toners are employed for forming the images. Conventional cleaning systems have not proven to be satisfactory in removing such toners from the charge retentive surface.

Toner image disturbance prior to removal from the charge retentive surface has been practiced as an adjust to the removal of residual toner from charge retentive surfaces. An example of such an arrangement is illustrated in U.S. Pat. No. 3,617,123 utilizes a vibrating brush as an adjunct to the cleaning effect by the developer system. There the vibrating brush is positioned upstream from the point where the photoconductor drum surface enters a combination development and cleaning. The brush is mounted longitudinally along the drum surface so that the brush fibers are in light touching contact with the surface to be cleaned and is vibrated transversely across the drum surface. Thus, the brush serves to reposition or puddle the charged residual toner particles over the drum so that they can be more readily removed by the combination development and cleaning system. A brush of this type physically dislodges the built-up residual toner and tends to spread it over the imaging surface. However, after periods of extended use the toner becomes impregnated in the bristles of the brush resulting in the brush becoming ineffective for its intended purpose.

Conductive brushes which are moved transversely to the direction of movement of the charge retentive surface are also known as illustrated in U.S. patent application Ser. No. 438,227 filed in the name of Lloyd F. Bean et al which is assigned to the same assignee as the instant application.

It is well known that the types of fiber brushes disclosed in U.S. Pat. No. 3,617,123 and the aforementioned application shed fibers which cause problems in the image making process. It will be appreciated that a residual toner removal apparatus that utilizes members (i.e. disturber and cleaning brush) that do not contain such fibers is desirable. Accordingly, as will be discussed hereinbelow, I have provided such a structure.

BRIEF DESCRIPTION OF THE INVENTION

I have provided a device capable of satisfactorily removing residual single component insulative magnetic toner from the charged surface of a charge retentive member. To this end, I have provided a pair of blade members mounted in intersecting planes such that an acute angle is formed between two adjacent ends and an obtuse angle is formed between the opposite ends thereof. The ends forming the acute angle delineate a gap which is positioned adjacent a charge retentive surface while the opposite ends are disposed adjacent a conventional magnetic cleaning cylinder or brush.

The magnetic brush is also supported adjacent the charge retentive surface downstream of the gap. The magnetic brush due to its rotation and proximity to the blades creates a pulsating magnetic field across the gap which, in turn, causes the magnetic toner deposited in the gap from the charge retentive surface to move back and forth in contact with the charge retentive surface thereby effecting redistribution of the residual toner thereon which renders it more suitable for removal by the magnetic brush. This redistributed toner is then attracted to the magnetic brush.

The blades are fabricated from soft magnetic material and are arranged such that the base of one is at one of the poles of the magnetic cylinder when the base of the other is between poles. Thus, the blades effectively amplify a magnetic field parallel to the long dimension thereof while allowing a field perpendicular to this dimension to pass through unchanged. With the blades positioned as described hereinabove a strong magnetic field and field gradient are produced along the surface of the charge retentive surface.

DETAILED DESCRIPTION OF THE DRAWINGS

In the detailed description of the invention, reference is made to the accompanying drawings in which.

DETAILED DESCRIPTION OF THE PREFERRED EMBODIMENT

Figure 1:
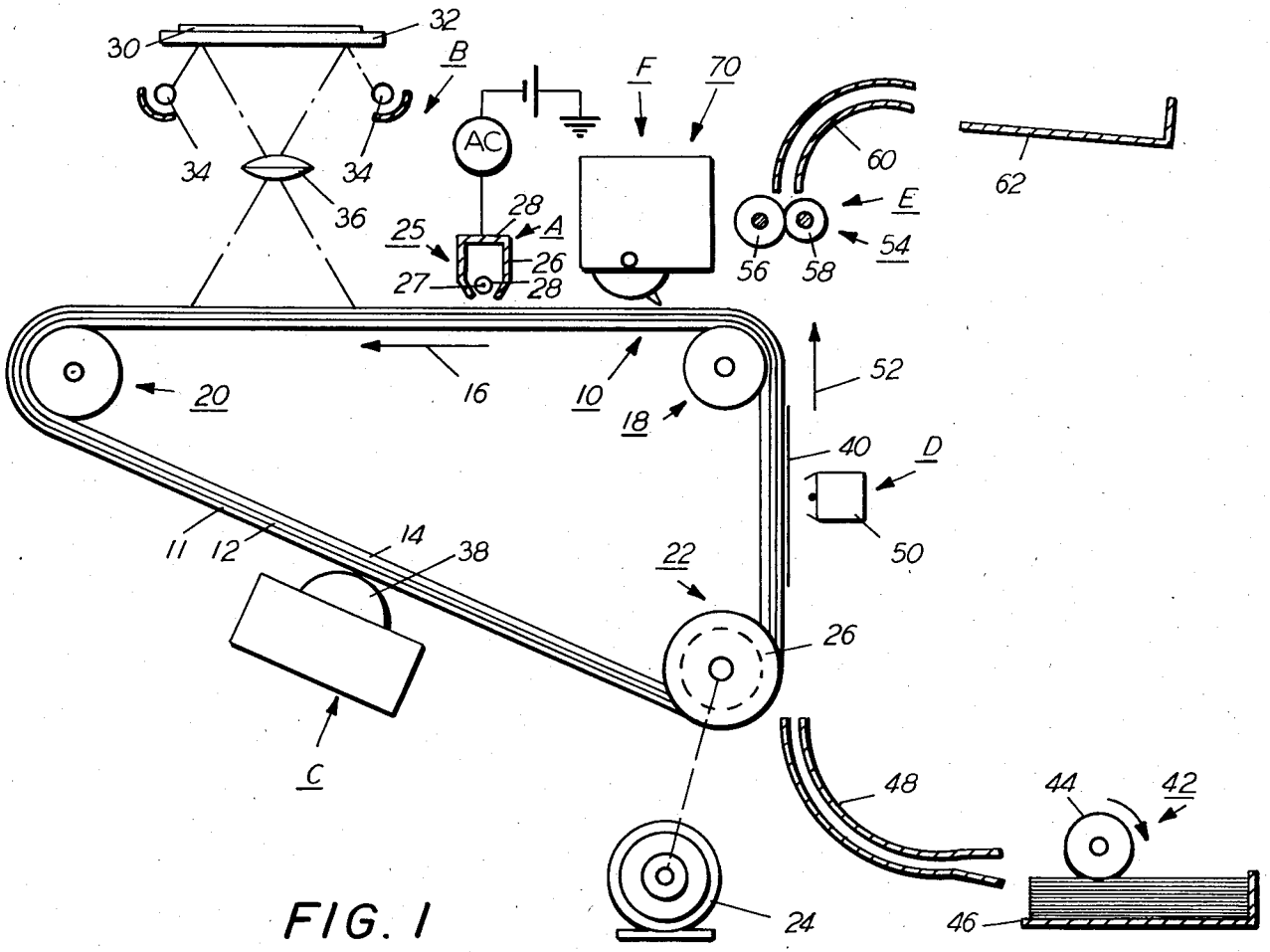
FIG. 1 is a schematic elevational view depicting a xerographic reproduction machine incorporating a toner removal structure forming a part of the present invention.

For a general understanding of the features of the present invention, a description thereof will be made with reference to the drawings. In the drawings, like reference numerals have been used throughout to designate identical elements. FIG. 1 schematically depicts the various components of an illustrative electrophotographic printing machine incorporating the apparatus of the present invention therein.

Inasmuch as the art of electrophotographic printing is well known, the various processing stations employed in the printing machine illustrated in FIG. 1 will be described only briefly.

As shown in FIG. 1, the printing machine utilizes a photoconductive belt 10 which consists of an electrically conductive substrate 11, a charge regenerator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive.

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, charges charge generator layer 12 of belt 10 to a relatively high, substantially uniform negative potential. A suitable corona generating device for negatively charging the photoconductive belt 10 comprises a conductive shield 26 and corona wire 27, the latter of which is coated with an electrically insulating layer 28 having a thickness which precludes a net d.c. corona current when an a.c. voltage is applied to the corona wire and when the shield an the photoconductive surface are at the same potential.

Next, the charged portion of photoconductive belt is advanced through exposure station B. At exposure station B, an original document 30 is positioned facedown upon transparent platen 32. Lamps 34 flashlight rays onto original document 30. The light rays reflected from original document 30 light image which are transmitted through lens 36. The light images are projected onto the charged portion of the photoconductive belt to selectively dissipate the charge thereon. This records an electrostatic latent image on the belt which corresponds to the informational area contained within original document 30.

Thereafter, belt 10 advances the electrostatic latent image to development station C. At development station C, a magnetic brush developer roller 38 advances a single component insulative magnetic developer into contact with the electrostatic latent image. The latent image attracts the toner particles thereby forming toner powder images on the photoconductive belt. The developer is loaded with magnetite in the order of 20–40% by weight. Alternatively, a two-component (i.e. carrier beads plus toner) developer could be used. In this instance, the loading is on the order of 20% by weight.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating device 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (now shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58. Sheet 40 passes between fuser roller 56 and back-up roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

Figure 2:
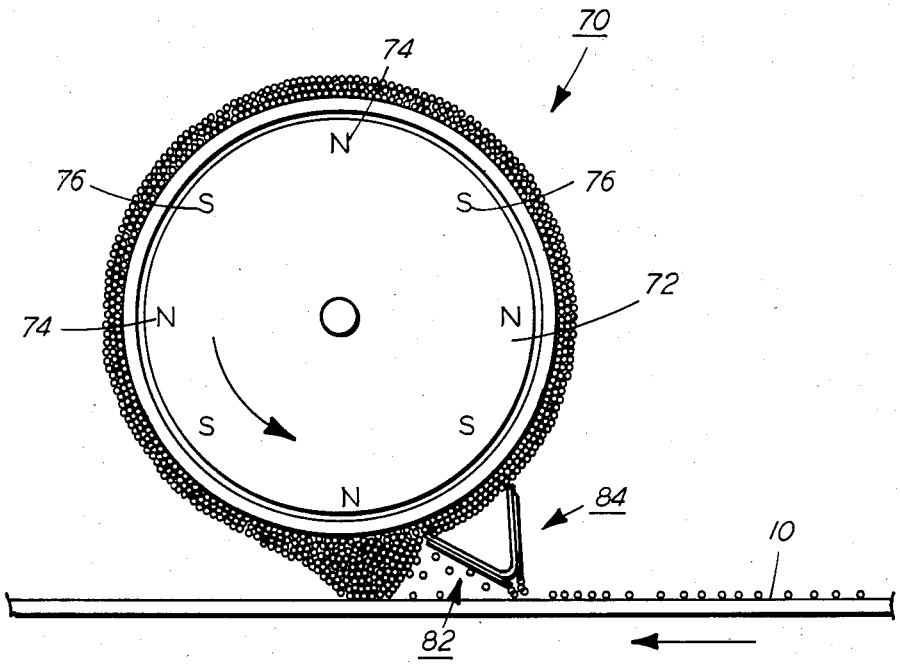
FIG. 2 is a schematic plan view of a toner removal structure forming a part of the present invention.
Figure 3:
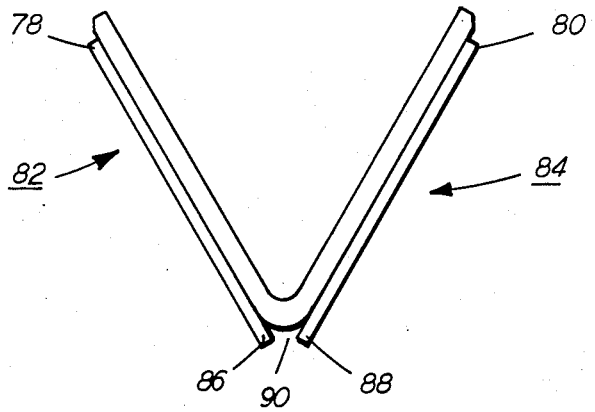
FIG. 3 is a enlarged plan view of an image disturber forming a part of the structure depicted in FIG. 2.

Illustrated in FIG. 2 is a residual toner removal structure indicated by reference character 70. The structure 70 comprises a magnetic cleaning cylinder 72 including a plurality of north and south poles schematically designated by reference characters 74 and 76, respectively. The cylinder 72 is supported for rotation adjacent to the charge retentive surface 10 such that the residual toner is attracted thereto to thereby clean the charge retentive surface. The residual toner removed from the charge retentive surface is also a single component material which preferably contains magnetite in an amount approximately equal to 40–60% by weight.

The cylinder 72 also rotates near ends 78 and 80 of blade members 82 and 84 fabricated from soft magnetic material such as steel. The blade members 82 and 84 are supported such that ends 86 and 88 form a gap 90 therebetween. The gap 90 is disposed adjacent the charge retentive surface 10, upstream of the point where the magnetic brush contacts it.

The magnetic brush due to its rotation and proximity to the magnetic blades creates a pulsating magnetic field across the gap which, in turn, causes the magnetic toner in the gap to move back and forth relative to the charge retentive surface thereby effecting redistribution of the residual toner thereon which renders it more suitable for removal by the magnetic brush.

The blades are fabricated from soft magnetic material and effectively amplify a magnetic field parallel to the long dimension thereof while allowing a field perpendicular to this dimension to pass through unchanged. With the blades positioned as described hereinabove, a strong magnetic field and field gradient are produced along the surface of the charge retentive surface.

As can now be appreciated, there has been disclosed a residual toner removal apparatus which is simple in construction, inexpensive to manufacture and reliable in operation due to the fact that natural fiber type components and carrier beads are not employed.

We claim:

1. Appartus for removing residual toner from a charge retentive surface; said apparatus comprising:

a magnetic brush having bristles and being supported adjacent said charge retentive surface such that said bristles contact said charge retentive surface;

a residual toner disturber supported adjacent said charge retentive surface upstream of said magnetic brush and adapted to condition said residual toner for removal by said magnetic brush;

said bristles comprising magnetic particles; and said disturber comprising a magnetic structure supported adjacent said magnetic brush whereby a magnetic field is passed therethrough upon rotation of said magnetic brush and said bristles are caused to contact residual toner on said charge retentive surface.

2. Apparatus according to claim 1, wherein said disturber comprises a pair of blades supported such that a narrower gap is formed between adjacent ends thereof, said narrower gap being disposed adjacent said charge retentive surface and the ends of said blades opposite the ends forming said narrow gap being disposed adjacent said magnetic brush whereby rotation of said magnetic brush creates oscillating magnetic waves across said gap causing toner in the gap to move back and forth across the gap while contacting residual toner on the charge retentive surface.

3. Apparatus for forming toner images on a charge retentive surface and removing residual toner from the surface, said apparatus comprising:

a magnetic brush having bristles and being supported adjacent said charge retentive surface such that said bristles contact said charge retentive surface;

a residual toner disturber supported adjacent said charge retentive surface upstream of said magnetic brush and adapted to condition said residual toner for removal by said magnetic brush;

said bristles comprising magnetic particles; and said disturber comprising a magnetic structure supported adjacent said magnetic brush whereby a magnetic field is passed therethrough upon rotation of said magnetic brush and said bristles are caused to contact residual toner on said charge retentive surface.

4. Apparatus according to claim 3 wherein said disturber comprises a pair of blades supported such that a narrow gap is formed between adjacent ends thereof, said narrow gap being disposed adjacent said charge retentive surface and the ends of said blades opposite the ends forming said narrow gap being disposed adjacent said magnetic brush whereby rotation of said magnetic brush creates oscillating magnetic waves across said gap causing toner in the gap to move back and forth across the gap while contacting residual toner on the charge retentive surface.

5. Structure for conditioning residual single component magnetic toner on a charge retentive surface for removal by a toner removal brush, said structure comprising:

disturber means for creating magnetic field oscillations adjacent said charge retentive surface for moving magnetic toner particles in contact with said charge retentive surface; and said disturber means comprising a pair of blades supported such that a narrow gap therebetween is formed between adjacent ends thereof, said narrow gap being disposed adjacent said charge retentive surface and the ends of said blades opposite the ends forming said narrow gap being disposed adjacent said magnetic brush whereby rotation of said magnetic brush creates said oscillating magnetic waves across said gap.

6. Apparatus for removing residual toner from a charge retentive surface, said apparatus comprising:

a magnetic brush for removal of toner particles from said charge retentive surface having bristles and being supported adjacent said charge retentive surface such that said bristles contact said charge retentive surface therefrom;

a residual toner disturber supported in closely adjacent and non-contacting relationship with said charge retentive surface, comprising a magnetic structure, supported upstream and adjacent said magnetic brush whereby a magnetic field is passed therethrough upon rotation of said magnetic brush, said magnetic structure adapted to apply a magnetic field to said toner to condition said residual toner before said toner is brought into contact with said magnetic brush.

* * * * *